US005553470A

United States Patent [19]

Hohne et al.

[11] Patent Number: 5,553,470

[45] Date of Patent: Sep. 10, 1996

[54] WARP KNITTING MACHINE WITH PIEZOELECTRICALLY CONTROLLED BENDING TRANSDUCERS FOR THE THREAD GUIDES

[75] Inventors: Hans-Jurgen Hohne, Hainburg; Kresimir Mista, Heusenstamm, both of Germany

[73] Assignee: Karl Mayer Textilmachinenfabrik GmbH, Obertshausen, Germany

[21] Appl. No.: 554,678

[22] Filed: Nov. 7, 1995

[30] Foreign Application Priority Data

Nov. 30, 1994 [DE] Germany ..... 44 42 555.4

[51] Int. Cl.[6] ..... D04B 27/26; D04B 27/32

[52] U.S. Cl. ..... 66/205; 66/204

[58] Field of Search ..... 66/203, 204, 205, 66/207; 84/DIG. 24

[56] References Cited

U.S. PATENT DOCUMENTS 3,729,954 5/1973 Ducol ..... 66/205

3,825,900 7/1974 Anderson ..... 66/205 X 5,390,512 2/1995 Mista ..... 66/205

5,491,988 2/1996 Hohne et al. ..... 66/204

*Primary Examiner*—John J. Calvert

*Attorney, Agent, or Firm*—Omri M. Behr, Esq.

[57] ABSTRACT

In a warp knitting machine at least one guide bar (8,9) carries piezoelectric bending transducers (14,15) to which are attached guides (11,12). A control arrangement (16) comprises a computer (17,19,20) and a potential generator, which provide the control potential via control lines (25) to the bending transducers. The potential source provided to a guide bar (8,9) comprises a plurality of serial to parallel converters (23) whose data and command inputs (22) are connected via a common data and command bus (21) with the computer and whose outputs (26) are connected with the bending transducers via the control lines (25). The serial to parallel converters (23) take up the data sequentially and upon occurrence of the switching command transmit them simultaneously in the form of control potentials. In this way rapidly running and/or large warp knitting machines can be provided with a operative piezoelectric jacquard control.

15 Claims, 4 Drawing Sheets

60
61
21
62
30
58
59
31
23.1
63
P/N1
P/N2
P/N31
P/N32
P/N33
P/N34
P/N63
P/N64

60
61
71
30
58
59
72
31
23.1
P1
N1
P2
N2
P31
N31
P32
N32
P33
N33
P34
N34
P63
N63
P64
N64

WARP KNITTING MACHINE WITH PIEZOELECTRICALLY CONTROLLED BENDING TRANSDUCERS FOR THE THREAD GUIDES

FIELD OF THE INVENTION

The invention is directed to a warp knitting machine having at least one guide bar whose guides are carried by piezoelectrically controlled bending transducers and having a control arrangement comprising a computer and potential generator which, in accordance with a desired pattern, provides the bending transducer, via at least one control lane with sufficient potential to displace it by one needle space.

BACKGROUND OF RELATED ART

In a known warp hitting machine of this type (U.S. Pat. No. 5,390,512 issued Feb. 21, 1995 to Mists), the piezoelectric bending transducers are provided with an electrode and a control line. By the application of the control potential the guide is moved out of its neutral position and displaced by one needle space into the working position. The control lanes are brought together into a wiring harness and attached to one or both ends of the jacquard guide bar. Based upon stored pattern values the computer generates a signal for each working cycle in dependence upon a rotational angle signal read from the main shaft which, by means of a direct current converter is converted into control potentials in the lower potential zone.

Such an arrangement is suitable for slow running or small warp knitting machines with a low number of piezoelectric bending transducers pattern. It is only in such arrangements that it is possible to control the bending transducers, in accordance with the desired pattern, within the predetermined section of the working cycle.

In DE OS 40 17 482, there is disclosed a switching arrangement for the pattern control of electromagnetic setting members of a textile machine, in particular a jacquard arrangement of a weaving machine. There are provided a plurality of serial/parallel converters in which a cycle line, a data line and a reset line are common. Each serial/parallel converter has a data shift register whose outputs are led to the electronic setting members.

SUMMARY OF THE INVENTION

In accordance with the illustrative embodiments demonstrating features and advantages of the present invention, there is provided a warp knitting machine having at least one guide bar, and a plurality of guides. Also included is a plurality of piezoelectric bending transducers mounted on the guide bar for deflectably supporting the guides. Each of the transducers has a control line for producing in response to control potential thereon, a displacement over one needle space of the guides. The warp knitting machine also has a control arrangement coupled to the control lines for establishing a predetermined pattern with a computer, a potential generating means and a plurality of serial to parallel converters. The computer has a common data and command bus. The potential generating means can provide, in dependence upon the predetermined pattern, a control potential to the control lines. The potential generating means has a plurality of serial to parallel converters distributed over the full width of the warp knitting machine. The converters have (a) a plurality of data and command inputs connected to the common data and command bus, and (b) a plurality of outputs connected through the control lines to the bending transducers. The serial to parallel converters can store some data sent sequentially along the bus and upon the occurrence of a switching command from the computer simultaneously release stored data by applying the control potential to data-selected ones of the control lines.

A preferred embodiment of the present invention employs thread guides carried by piezoelectrically controlled bending transducers, which can be displaced in dependence on the pattern in larger and/or more rapidly running warp knitting machines with a higher degree of running certainty.

Preferably, a potential generator provided to a guide bar has a plurality of serial to parallel converters, whose data and command inputs run over a common data or command bus and are connected with a computer. The outputs of the converters are connected to the bending transducers via the control lines. The serial to parallel converters sequentially take up the data and upon the appearance of a switching command in the form of control potential, surrender them simultaneously. The serial to parallel converters are preferably attached to and distributed over the width of the machine.

This construction ensures that all the bending transducers are activated at the same point in time. This is determined by a switching command, which is, suitably, generated in dependence upon the rotational angle position of the main shaft. Practically the entire remainder of the working cycle is available for reading the data into an intermediate storage means of the serial to parallel converter.

Thus, it is possible to provide trouble-free operation even with faster running warp knitting machines and those with a very large number of bending transducers. Since serial to parallel converters of the type to be considered herein can only dispose of a limited number of data with a limited number of outputs, a substantial number of such transducers is required for each guide bar. However, since sufficient time is available for the task, these can be sequentially provided with data over a common data bus, wherein the data intended for each transducer can be provided with a predetermined address for that particular transducer.

The distributed arrangement of the transducers over the width of the machine makes it possible to keep all control lines comparatively short and to give them substantially the same length. In this way, the length of the control lines, which can lead to switching delays, can be held small and is the same for all of the bending transducers.

It is preferred to utilize high voltage, serial to parallel converters which yield a control potential of at least 200 volts. Such a potential can equally be supplied to the individual converters over a common bus line. The level of the potential permits the use of relatively small and thus capacity-poor bending transducers, which can be rapidly and securely switched.

It is further desirable that each serial to parallel converter is connected to the appropriate control line via a series resistor. This resistor limits the loading and unloading current for each bending transducer. It is so chosen that all of the bending transducers apply to the same circumstances, in particular the same switching speed.

It is further advantageous to provide that the data and command inputs of each serial to parallel converter are connected with a common bus via an optical coupler. The optical couplers protect the computer if there is a short circuit in the bending transducers.

It has been found particularly advantageous to provide the serial to parallel converters in individual structural assemblies, which are detachably affixable to a transom fixed to the machine. For this purpose each assembly is connected via an input plug connection to the bus and via an output plug connection to the control lines leading to the bending transducers of a guide set. Such a type of construction is very rapidly assembled and exchanged. Since the structural assemblies for each serial to parallel converter of a warp knitting machine can be the same, only a small spare parts storage is required. To correct failures, the assemblies can be repaired in a repair shop.

It is further advantageous that each bending transducer is provided with two differentiably activatable electrodes and thus each bending transducer is designated to two outputs of a serial to parallel converter. Such a bending transducer can be moved from a central at-rest position by means of the application of a control potential into either a left or a right working position in which, during power activation, they lie against a stop means. This provides a high positional security coupled with a relatively small bending of the bending transducer.

It is particularly advantageous to provide each assembly with a serial to parallel converter having 64 outputs and two output plug connections for each of the 32 control lines. Each set of sixteen bending transducers are thus provided to a guide set which is designated to the output plug connection. This guide set can similarly form a structural assembly which, after separation of the plug connection, may be disconnected from the guide bar.

It is also advantageous to provide that the serial to parallel converter possesses a group of switchable P-channels and a group of switchable N-channels, wherein a pair of P- and N-channels contains a common output, while their data inputs are connected with each other via an inverter. In accordance with choice, either the P- or the N-channels are activated at the output. By inversion of the data in the inverter, it is sufficient to provide each pair with only one bit for control. Furthermore, where there is separate control, the presence of the inverter prevents the possible short circuits between both channels.

In a desirable alternative, the serial to parallel converter comprises a group of switchable P/N channels, whose outputs are pair-wise provided to a single bending transducer; whereby the data input of each pair can be mutually connected by means of an inverter. Also here, by the use of an inverter, it is possible to reduce the amount of information to one bit per pair.

It is further advantageous to provide to each bending transducer, a strip-formed, electrically non-conductive carrier, which carries on each side, an inner electrode connected to an output of a serial to parallel converter, a piezoelectrically active layer, and a grounded outer electrode. Because of this grounded outer electrode, such a bending transducer is contact-safe which, in conjunction with the high control potential, is exceedingly useful.

BRIEF DESCRIPTION OF THE DRAWINGS

The invention is further illustrated by reference to the accompanying drawings illustrating the preferred embodiments, wherein.

DETAILED DESCRIPTION OF THE PREFERRED EMBODIMENTS

Figure 1:
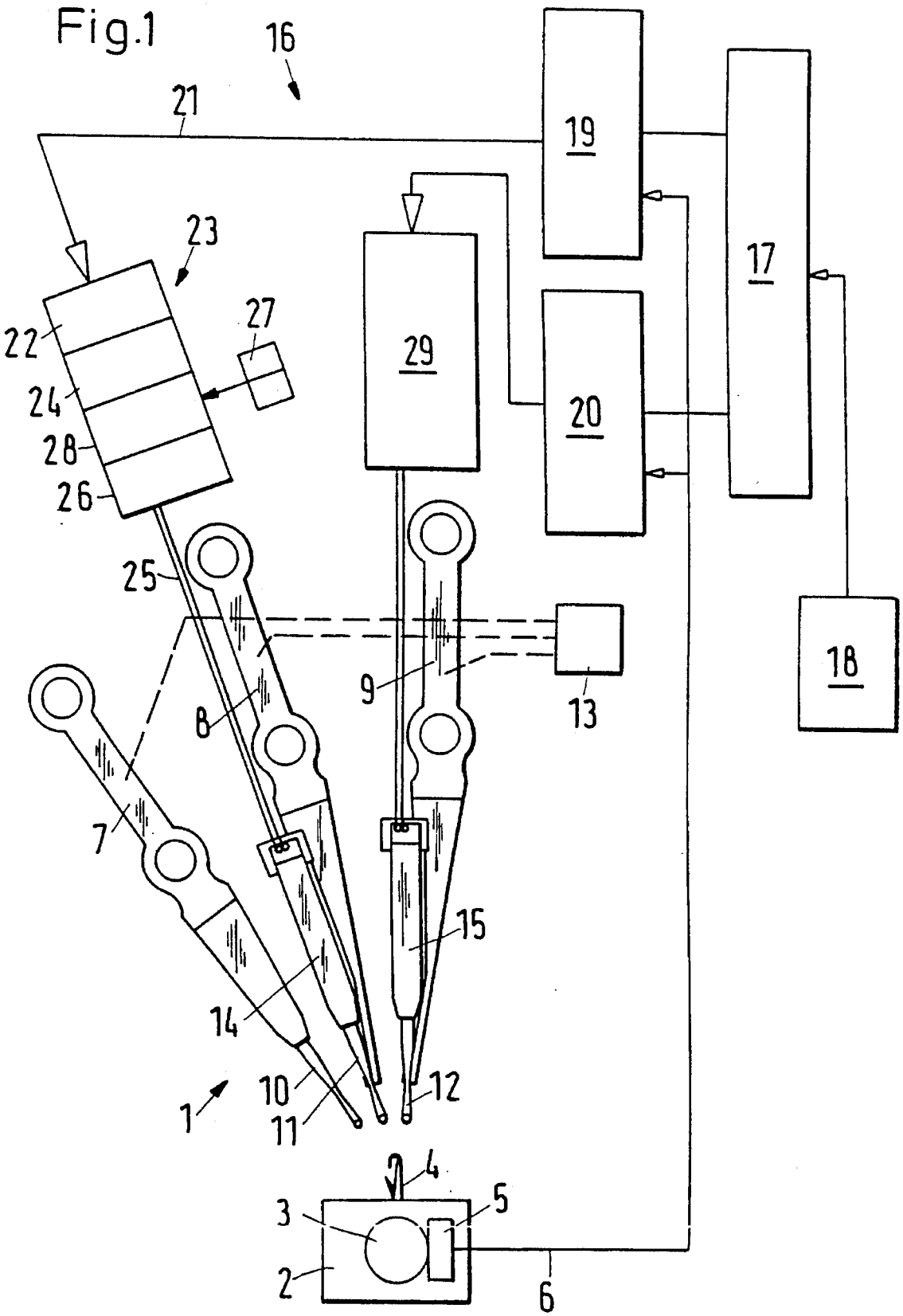
FIG. 1 is a schematic, side elevational representation of a warp knitting machine according to the principles of the present invention, and including a schematic of a control arrangement.

Referring to FIG. 1, the warp knitting machine (1) illustrated in FIG. 1 comprises a machine frame (2) having a main shaft (3) as well as a knitting needle bar (4) (illustrated schematically). A rotational angle measuring means (5) provides a rotational angle signal over line (6).

Three guide bars (7,8 and 9) are equipped with guides (10, 11 and 12) which, as is conventional, are swingable to and fro from an underlap position to an overlap position and back, as well as a displacement arrangement (13) for shogging them over one or more needle spaces parallel to needle bar (4).

The guides (10) are rigidly affixed to guide bar (7). These serve for the production of the ground fabric. The guides (11) are connected to the appropriate guide bar via bending transducers (14) as are guides (12) via bending transducers (15). By means of the bending transducers, the guides can be displaced by one needle space, thus serving the pattern formation of the fabric.

A control arrangement (16) is provided for the activation of these bending transducers. This comprises a main computer (17) provided with a pattern storage means (18), as well as subordinate computers (19 and 20) for each guide bar (8 and 9). The computer (19) is connected with input (22) of a high voltage serial to parallel converter (23). This possesses an intermediate storage means (24) in the form of a shift register into which the particular data for displacing the bending transducer (14) are read in sequentially. Each bending transducer (14) is connected to the outputs (26) of the high voltage serial to parallel converter by two control lines (25). These control lines serve to provide the control potential to the bending transducer generated by the potential control arrangement (27). For this purpose, connecting extension channels (28) are provided, which activate the accumulated data in intermediate storage means (24) when the rotational angle signal given off by line (6) reaches a particular value. The high voltage serial to parallel converter (29) for guide bar (9) is constructed in a similar manner.

Figure 2:
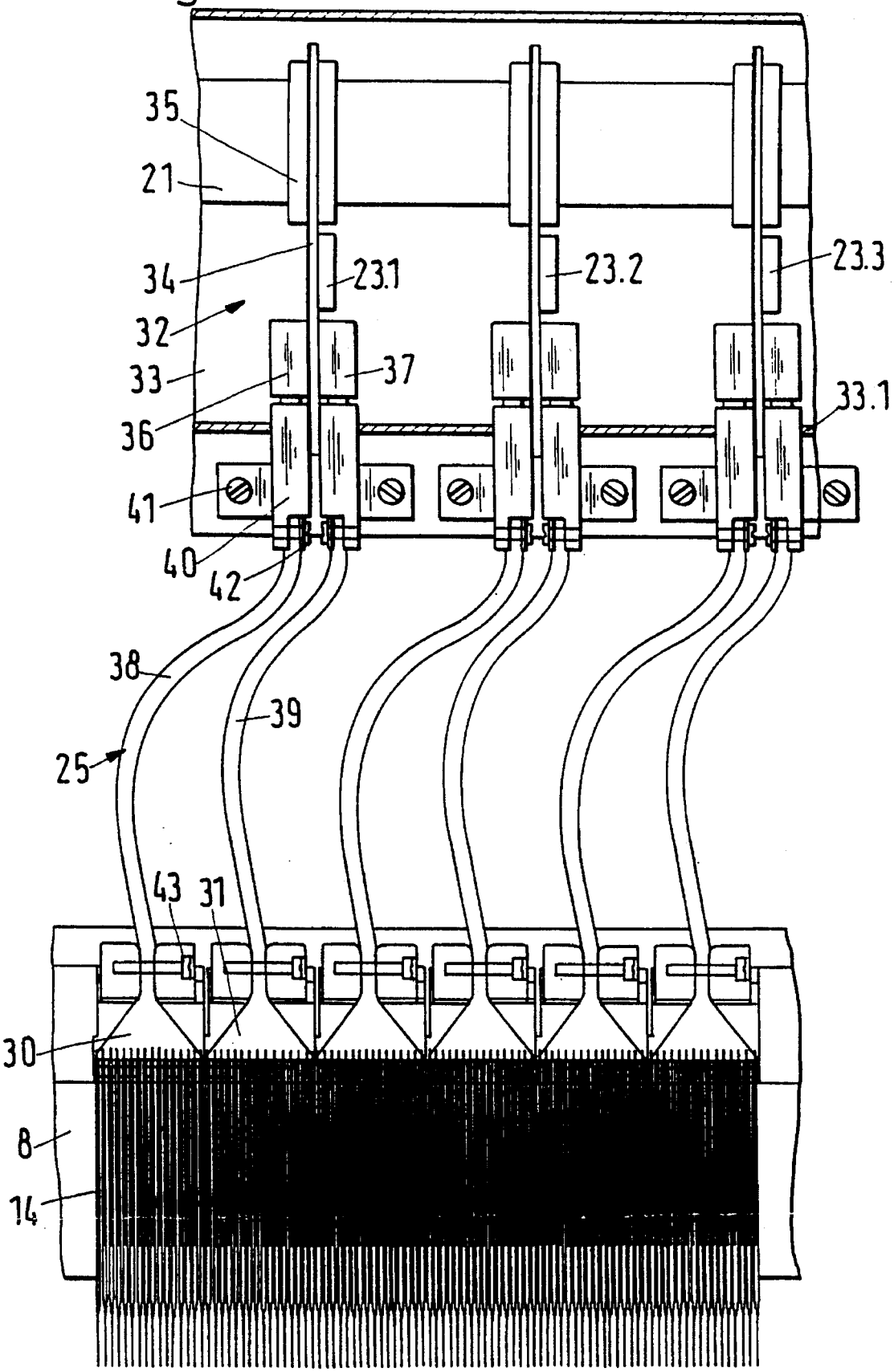
FIG. 2 is a portion of the warp knitting machine of FIG. 1 viewed in front elevation.

High voltage serial to parallel converters are commercially available. However, they only have a limited number of outputs, for example 64 outputs. For this reason, as shown in FIG. 2, a substantial number of such high voltage serial to parallel converters (23.1 to 23.3) are distributed over the machine width. The inputs of converters (23.1 to 23.3) lie on a common bus (21) and are responsible for two sets of guides (e.g., sets 30 and 31) of sixteen bending transducers (14) each.

Each of these high voltage serial to parallel converters is part of a structural assembly (32) which is fastened to a transom (33) above guide bar (8) in a readily detachable manner and are covered by a housing (33.1). This structural assembly (32) comprises a printed circuit board (34) on which converter (23.1) is provided as an integrated circuit chip. A plug-type, input connector (35) connects the input of the converter with a bus (21). Two plug-type, output connectors (36 and 37) each serve as connections for thirty two output lines (25) which are taken together to form two wire harnesses (38 and 39). The plug connections permit this assembly (32) to be readily installed and dismounted.

The plug portions (40) of the output plug combination (36 and 37) are connected to the transom (33) by means of a releasable screw (41). The guide segments (30 and 31) are similarly releasably fastened to guide bar (8). Thus, it is equally simple to attach and remove the guide segments.

As may be seen from FIG. 2, the structural assemblies (32) are attached next to each other with some separation on transom (33). Thus, wire harnesses (38 and 39) and equally output line (25) have substantially the same, short length. Clamping arrangements (42) on plug portion (40) and clamping arrangement (43) on needle segments (30 and 31) serve to reduce tension load.

Figure 3:
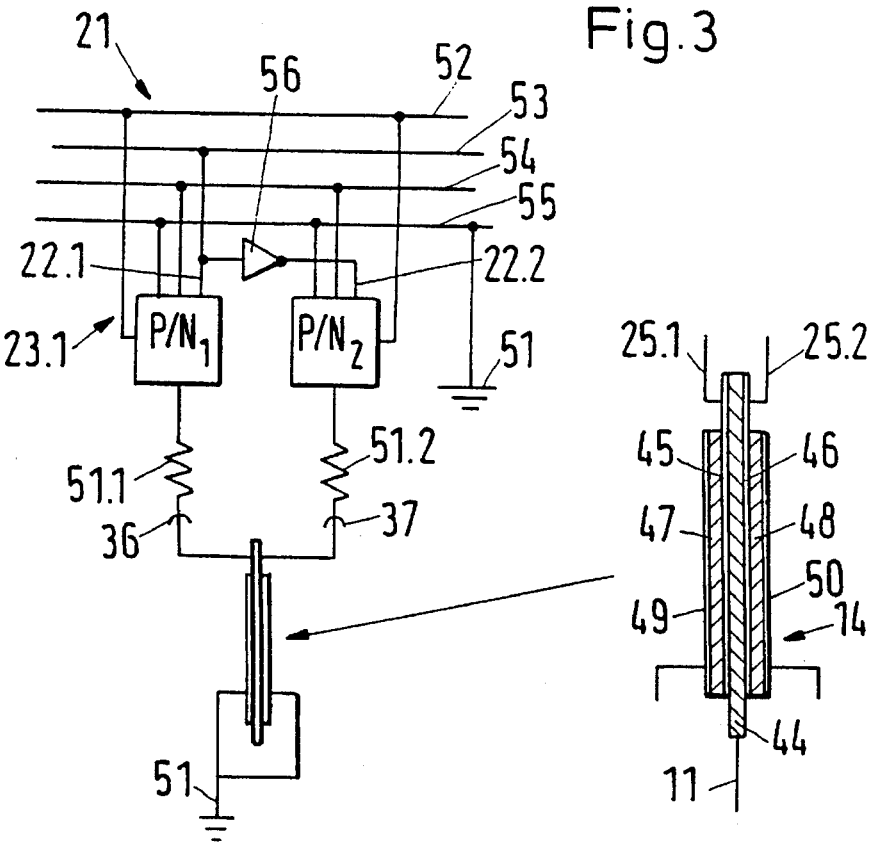
FIG. 3 is schematic representation of a portion of a serial to parallel converter of FIG. 1 and 2 for a bending transducer.

As illustrated in FIG. 3, the bending transducer (14) for the guide (11) has, suitably, the following construction: A strip-formed carrier (44) of electrically insulating material is coated on each side thereof with an inner electrode (45 and 46), which itself is coated with a piezoelectric layer (47 and 48, respectively) and again respectively covered with an outer electrode (49 and 50). The inner electrodes (45 and 46) are connected with the output lines (25.1 and 25.2), the outer electrodes (49 and 50) are connected to ground.

In FIG. 3, it is further illustrated that each bending transducer (14) has two switchable P/N channels ($P/N_1$ and $P/N_2$). These can be switched in either direction, depending upon the provision of current to one or the other. Their outputs run via serial resistors (51.1 and 51.2) to output lines (25.1, 25.2).

The common bus (21) comprises a plurality of common lines. A supply line (52) is arranged to provide the necessary control potential to the high voltage serial to parallel converter, suitably +5 volts. A potential control line (54) is connected with the potential control arrangement (arrangement 27 in FIG. 1) and provides, for example, a potential of +220 volts. A ground line (55) is connected to ground (51).

A data line (53) provides a path from the computer for the necessary data for the displacement of the bending transducer, namely, the addresses of the individual high voltage serial to parallel converters, as well as the switching commands for release of the stored data. The data input (22.1) of channel $P/N_1$ is connected to the data input (22.2) to the $P/N_2$ channel via an inverter (56) to act as a counteracting pair. This has the consequence that, as desired, the left inner electrode (45) or the right inner electrode (46) is provided with control potential while the other inner electrode is grounded. In the first case, the guide swings to the left; in the second case to the right.

Figure 4:
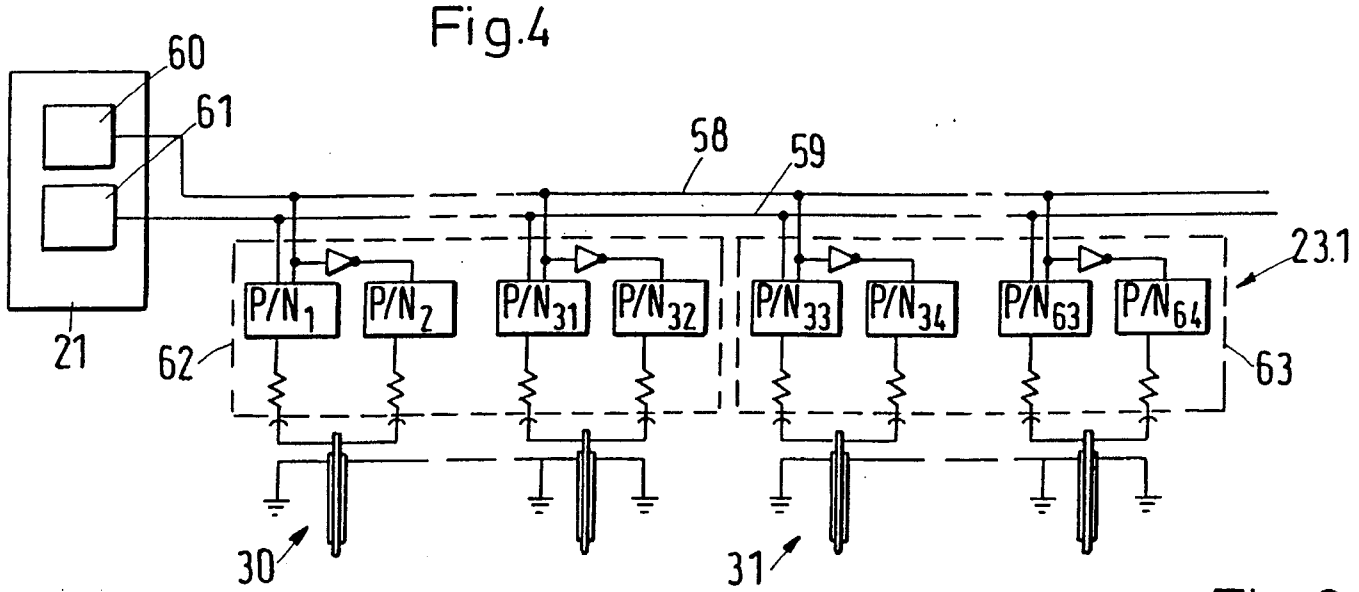
FIG. 4 is a schematic representation of a structural assembly with attached bending transducers that may be employed in the arrangement of FIG. 2.

FIG. 4 shows how a data line (58) over which data and addresses are transmitted from the computer, are coupled via an optical coupler (60,61) through a common bus (21) or a branch thereof. A command line (59) controls the input and output of the data. Coupler (60,61), also referred to as an optical coupling means, prevents any short circuits that might occur in the bending transducers from having a disadvantageous impact upon the computer.

Furthermore, it may be seen that the switchable channels $P/N_1$ through $P/N_{32}$ are coupled to the guide segments (30), (comprising sixteen guides) and switchable channels $P/N_{33}$ through $P/N_{64}$ are coupled to guide segment (31) (comprising sixteen guides). Guide segments 30 and 31 are connected to channel sets 62 and 63, respectively.

Figure 5:
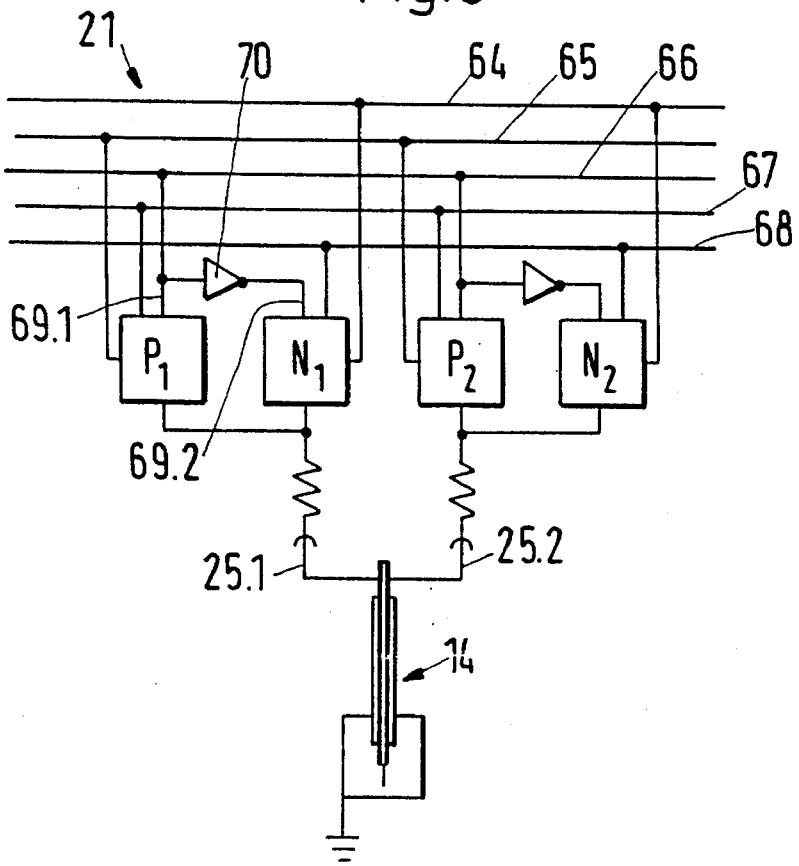
FIG. 5 is a schematic representation of a different serial to parallel converter portion, which is an alternate to that of FIG. 3.

FIG. 5 shows a further embodiment which can be distinguished from that of FIG. 3 in that for each output line (25.1 and 25.2) of bending transducer (14) there is provided a pair of switchable channels, namely, a P-channel ($P_1$ and $P_2$) and an N-channel ($N_1$ and $N_2$). In this case, the bus (21) possesses a supply line (64) for a positive energization potential, a supply line (65) for a negative energization potential, a data line (66), and a control potential supply line (67) for a positive control potential, for example +220 volts. Bus (21) also has a control potential supply line (68) for a negative control potential of, for example, −30 volts.

For each complementary pair of P- and N-channels, the data inputs (69.1 and 69.2) are mutually connected via an inverter (70). This ensures that only one of the two channels is active at any one time.

In this switching mode, one of the inner electrodes (45, inset of FIG. 3) of a bending transducer (14) is provided with a positive control potential and the outer electrode (46) with a negative control potential. This leads to a rapid transition.

Figure 6:
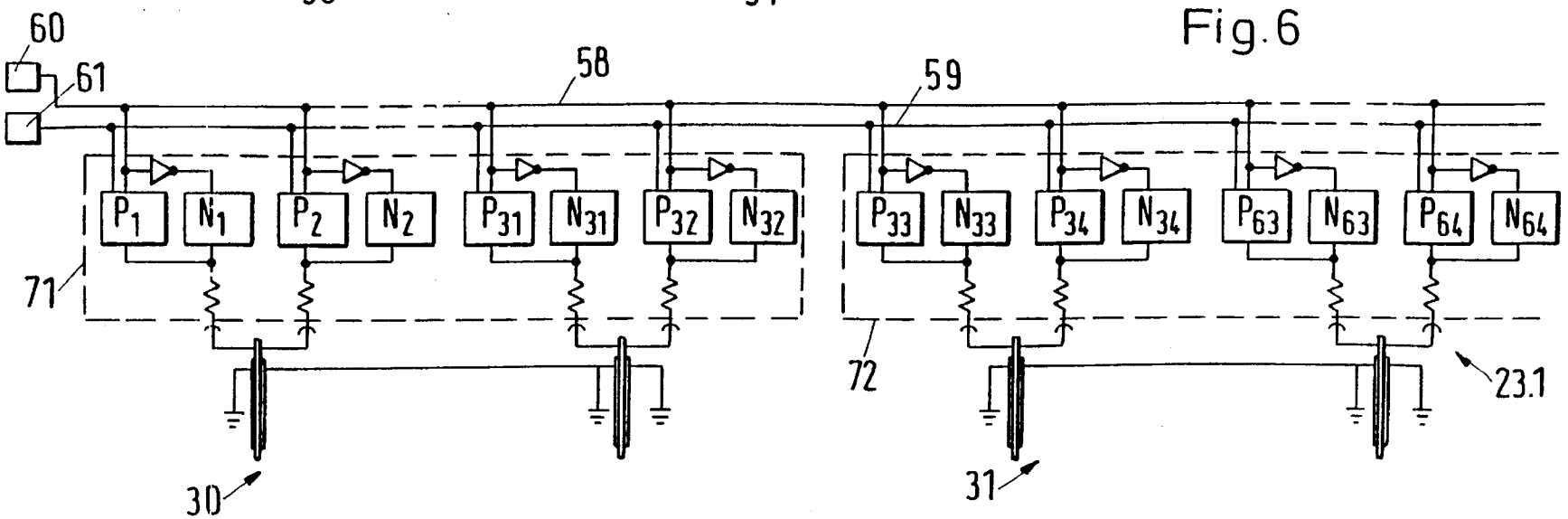
FIG. 6 is a schematic representation of structural assembly of the control arrangement with attached bending transducers, which is an alternate to that of FIG. 4.

In FIG. 6, a variant of FIG. 4 is illustrated with the dotted boxes (71,72) showing switchable channels $P_1$ through $P_{32}$ and $N_1$ to $N_{32}$ coupled to guide segment (30); and switchable channels $P_{33}$ through $P_{64}$ and $N_{33}$ through $N_{64}$ coupled to guide segment (31).

As the high voltage, serial to parallel converters with switchable P/N channels in accordance with FIG. 4, there may be used the type HV35, manufactured by Supertex Incorporated, Central U.S., 1200 Country Club Lane, Street 102, Fort Worth, Tex. 76112 and for switchable P-channels and N-channels, in accordance with FIG. 6, the type HV49 and HV31 from the same company are utilized.

We claim:

1. Warp knitting machine comprising:

at least one guide bar;

a plurality of guides;

a plurality of piezoelectric bending transducers mounted on said guide bar for deflectably supporting the guides, each of the transducers having a control line for producing in response to control potential thereon a displacement over one needle space of said guides; and a control arrangement coupled to the control lines for establishing a predetermined pattern comprising:

a computer having a common data and command bus; and a potential generating means for providing, in dependence upon the predetermined pattern, a control potential to the control lines, said potential generating means comprising:

a plurality of serial to parallel converters distributed over the full width of the warp knitting machine and having (a) a plurality of data and command inputs connected to said common data and command bus, and (b) a plurality of outputs connected through the control lines to the bending transducers, the serial to parallel converters being operable to store some data sent sequentially along said bus and upon the occurrence of a switching command from said computer simultaneously release stored data by applying the control potential to data-selected ones of said control lines.

2. Warp knitting machine in accordance with claim 1, wherein the serial to parallel converters are operable to provide control potential on said control lines at a magnitude exceeding that on said common data and command bus.

3. Warp knitting machine in accordance with claim 1, wherein the serial to parallel converters are operable to provide control potential on said control lines of at least 200 volts.

4. Warp knitting machine in accordance with claim 2, wherein each output of the serial to parallel converters are serially and resistively coupled to a corresponding one of the control lines.

5. Warp knitting machine in accordance with claim 4, comprising:

an optical coupling means for coupling said common data and command bus with the data and command inputs of each of the serial to parallel converters.

6. Warp knitting machine in accordance with claim 1, comprising:

an optical coupling means for coupling said common data and command bus with the data and command inputs of each of the serial to parallel converters.

7. A warp knitting machine in accordance with claim 6, wherein the serial to parallel converters have a plurality of input connectors and output connectors, the warp knitting machine comprising:

a transom affixed to the warp knitting machine, each of said serial to parallel converters being detachably mounted on said transom, and being detachably connected (a) with the bus through a corresponding one of the input connectors, and (b) through a corresponding one of the output connectors with the control lines, each of said output connectors being associated with a different corresponding group of the bending transducers.

8. A warp knitting machine in accordance with claim 2, wherein the serial to parallel converters have a plurality of input connectors and output connectors, the warp knitting machine comprising:

a transom affixed to the warp knitting machine, each of said serial to parallel converters being detachably mounted on said transom, and being detachably connected (a) with the bus through a corresponding one of the input connectors, and (b) through a corresponding one of the output connectors with the control lines, each of said output connectors being associated with a different corresponding group of the bending transducers.

9. A warp knitting machine in accordance with claim 1, wherein the serial to parallel converters have a plurality of input connectors and output connectors, the warp knitting machine comprising:

a transom affixed to the warp knitting machine, each of said serial to parallel converters being detachably mounted on said transom, and being detachably connected (a) with the bus through a corresponding one of the input connectors, and (b) through a corresponding one of the output connectors with the control lines, each of said output connectors being associated with a different corresponding group of the bending transducers.

10. A warp knitting machine in accordance with claim 9, wherein each bending transducer comprises:

a pair of distinct, activatable electrodes separately connected to a corresponding pair of the outputs of the serial to parallel converters.

11. A warp knitting machine in accordance with claim 1, wherein each bending transducer comprises:

a pair of distinct, activatable electrodes separately connected to a corresponding pair of the outputs of the serial to parallel converters.

12. A knitting machine in accordance with claim 11, wherein the serial to parallel converters are segregated into a plurality of assemblies, each of the assemblies further comprising:

a pair of output connectors for connecting 64 of the outputs of the serial to parallel converters to a corresponding number of the control lines.

13. Warp knitting machine in accordance with claim 11, wherein the serial to parallel converters comprise:

a plurality of complementary pairs of switchable channels, each complementary pair of channels having a common output and an inverter, the channels of each complementary pair having channel inputs interconnected via said inverter.

14. Warp knitting machine in accordance with claim 11, wherein the serial to parallel converters comprise:

a plurality of switchable channels each having a channel input and one of the outputs of a different corresponding one of the serial to parallel converters, each of the bending transducers being coupled to the outputs of a counteracting pair of the switchable channels, each counteracting pair having an inverter, the channel inputs of each counteracting pair being connected with each other via the inverter.

15. Warp knitting machine in accordance with any of claim 10, wherein the bending transducers each comprise:

a strip-formed, electrically insulating carrier; and a spaced pair of active means mounted on opposite sides of said carrier, each of said active means comprising:

(a) an inner electrode connected with a corresponding one of the outputs of the serial to parallel converters, (b) a piezoelectrically active layer mounted on said inner electrode, and (c) a grounded outer electrode mounted on said active layer opposite said inner electrode.

* * * * *